United States Patent [19]

Mitarai et al.

[11] 4,414,878

[45] Nov. 15, 1983

[54] TONE DATA COMPRESSING AND EXPANDING SYSTEM FOR DIGITAL ELECTRONIC MUSICAL INSTRUMENT

[75] Inventors: Tsuyoshi Mitarai, Yokohama; Takeshi Yamaguchi, Kodaira, both of Japan

[73] Assignee: Casio Computer Co., Ltd., Tokyo, Japan

[21] Appl. No.: 331,973

[22] Filed: Dec. 18, 1981

[30] Foreign Application Priority Data

Dec. 27, 1980 [JP] Japan ..... 55-188787

[51] Int. Cl.[3] ..... G10H 1/057; G10H 1/06; G10H 1/46

[52] U.S. Cl. ..... 84/1.19; 84/1.26; 84/1.27; 381/31

[58] Field of Search ..... 84/1.01, 1.03, 1.11–1.13, 84/1.19–1.27; 179/15.55 R

[56] References Cited

U.S. PATENT DOCUMENTS 4,282,790 8/1981 Wachi ..... 84/1.21

FOREIGN PATENT DOCUMENTS 2910472 9/1979 Fed. Rep. of Germany.

*Primary Examiner*—Stanley J. Witkowski

*Attorney, Agent, or Firm*—Frishauf, Holtz, Goodman and Woodward

[57] ABSTRACT

A tone signal having been data compressed or expanded is obtained through a circuit for taking the sum of upper three bits of envelope data, a latch for storing the output of said circuit, a circuit for setting the extent of bit shift of digital tone data according to the output of said latch, a latch group for latching the tone data having been bit shifted according to the output of the setting circuit, and an amplifier, the amplification level of which is set according to the extent of bit shift and which receives and amplifies the bit shifted tone data from a digital-to-analog converter.

6 Claims, 5 Drawing Figures

TONE DATA COMPRESSING AND EXPANDING SYSTEM FOR DIGITAL ELECTRONIC MUSICAL INSTRUMENT

BACKGROUND OF THE INVENTION

This invention relates to tone data compressing and expanding systems, which provide digital tone data and convert the digital tone data thus produced into an analog tone signal after superimposing the data on envelope data.

Recently, various digital electronic musical instruments, which convert digitally formed tone data into an analog signal through a digital-to-analog converter (hereinafter referred to as D/A converter), have been developed and put to practical use.

In such digital electronic musical instruments, however, the volume varies with the number of operated keys when producing a chord. For example, the volume ratio between the case of producing a single tone and the case of producing a chord consisting of eight different tones is 1:8 at the most. To be able to express digitally eight times the volume, three extra bits are required for a chord consisting of 8 tones compared to the case of a single tone. If a 12-bit D/A converter, for instance, is used and set to the 8-tone chord, the single tone is expressed by the lower 9 bits, i.e., the upper 3 bits are not used to express the single tone, so that the tone quality is greatly deteriorated.

Conversely, if the aforementioned D/A converter is set to the single tone output, i.e., if 12 bits are set to express a single tone, an overflow always results with a chord. To avoid this, it is necessary to provide D/A converters for the individual tones or use a 15-bit D/A converter than can express 8-tone chords as well.

The former case, i.e., using D/A converters for the individual tones leads to an increased cost. In addition, the electronic musical instrument system size is increased, which is undesired particularly for a portable electronic musical instrument. The latter case, i.e., use of the 15-bit D/A converter, is undesired from the standpoint that with the usual electronic musical instrument the expression of tone signal with 12 bits (corresponding to 72 dB of dynamic range) is sufficient.

SUMMARY OF THE INVENTION

An object of the invention is to provide a tone data compressing and expanding system for a digital electronic musical instrument, which can always supply effective data to a D/A converter irrespective of the content of the digital tone data, thus permitting a significant improvement of the dynamic range to permit high quality musical sound to be obtained.

According to the invention, to attain the above object there is provided, in a digital electronic musical instrument having means for forming digital tone data, means for forming envelope data for controlling the envelope of the digital tone data, means for combining the digital tone data and envelope data to obtain envelope controlled composite tone data and a digital-to-analog converter for converting the composite tone data into an analog waveform signal, a tone data compressing and expanding system comprising means for setting the extent of bit shift of the digital tone data supplied to the digital-to-analog converter according to the envelope data, and control means for supplying the tone data after it is bit shifted by a number of bits corresponding to the output of the setting means to the digital-to-analog converter, wherein compression and expansion of the tone data are effected by the bit shift operation of the setting means.

DETAILED DESCRIPTION OF THE PREFERRED EMBODIMENT

Now, an embodiment of the invention will be described in detail with reference to the drawings.

Figure 1:
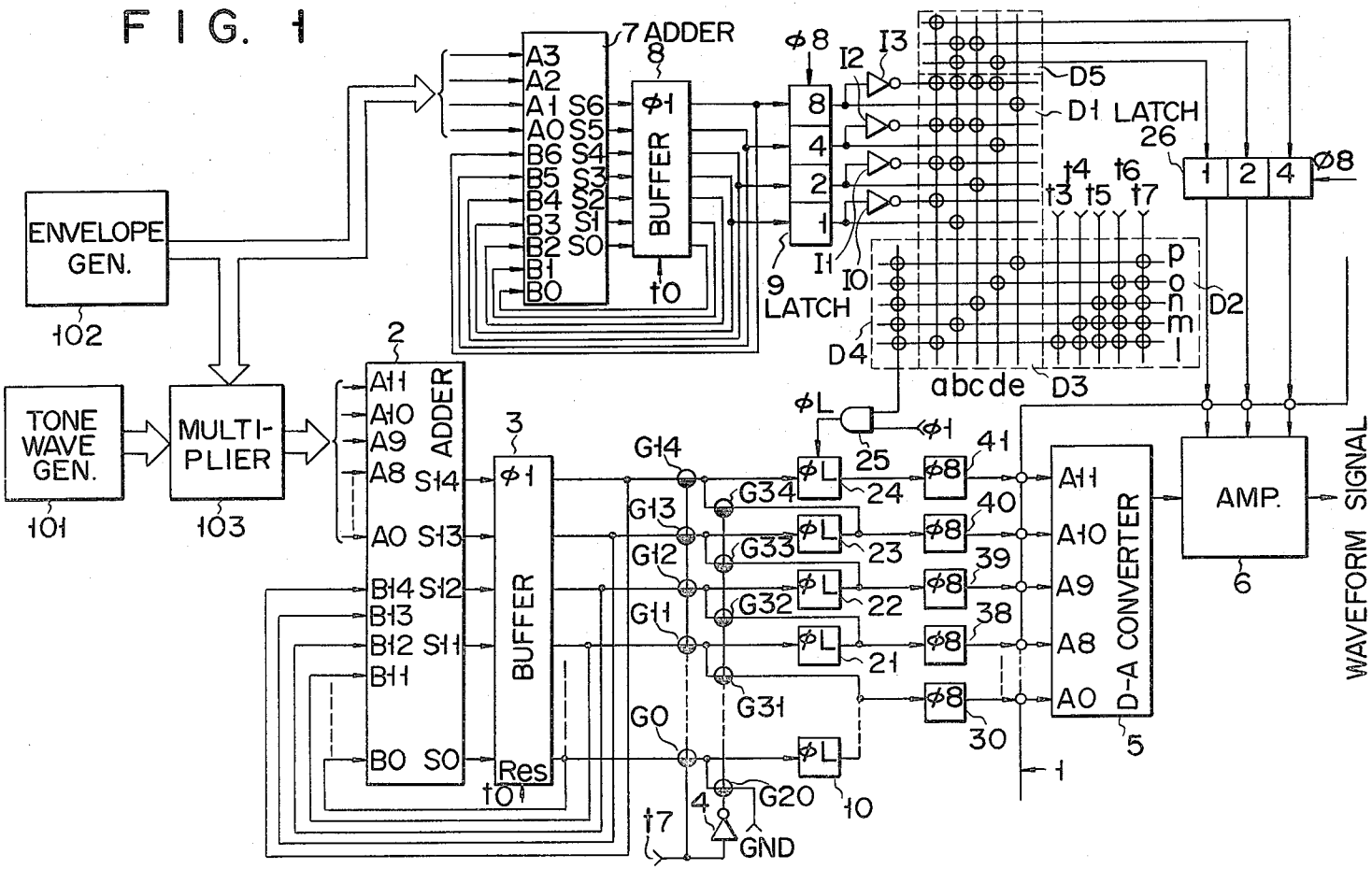
FIG. 1 shows a block diagram of one embodiment of the invention.

FIG. 1 shows the circuit construction of the embodiment. The digital circuit section of the electronic musical instrument of this embodiment is constructed in an LSI 1, which includes a tone wave generator 101, an envelope generator 102 and a multiplier 103 for producing envelope controlled amplitude data through combination of both the signals. The envelope controlled amplitude data (of 12 bits) is fed to input terminals A11 to A0 (12 bits) of an adder 2. To input terminals B14 to B0 (15 bits) of the adder 2 is fed the output of a buffer 3, in which the output of the adder 2 is stored. More particularly, the adder 2 adds the input data fed to its input terminals A11 to A0 and B14 to B0 and provides the result data from its output terminals S14 to S0 (15 bits).

The output of the adder 1 is latched in the buffer 3 for every clock $\phi$1 (to be described later). A timing signal t0 (to be described later) is supplied to a reset terminal Res of the buffer 3. The output of the buffer 3 is fed to gates G14 to G0, which are enabled for every timing signal t7 and is otherwise disabled. The outputs of the gates G14 to G0 are coupled to 15 latches 24 to 10.

The operation of reading of the latches 24 to 10 is carried out under the control of a clock $\phi$L. The outputs of the latches 24 to 13 are fed to 12 latches 41 to 30, the reading operation thereof being controlled by a clock $\phi$8, and are also fed to latches 24 to 11 higher in rank than the respective latches 23 to 10 by one bit through gates G34 to G21. To the gate G20 a ground level voltage GND (of "0" level) is applied. To the gates G34 to G20, a signal $\overline{t7}$ from an inverter 4 inverting the timing signal t7 is supplied.

The contents in the latches 24 to 10 are thus shifted by one bit to the upper rank side every time the clock $\phi$L is provided. The amplitude data (12 bits) as tone data read out from the latches 41 to 30 is fed to input terminals A11 to A0 of an external D/A converter 5 for conversion into an analog signal, which is amplified by an amplifier 6 to a predetermined level (to be described later) and provided as a wave signal.

Of the envelope data provided from the envelope generator 102 the upper four-bit data are fed to A input terminals A3 to A0 of an adder 7. To B input terminals B6 to B0 of the adder 7 are fed outputs of a buffer 8, to which the output of the adder 7 is latched. More particularly, the buffer 8 is supplied with the result of addition of data coupled to the input terminals A3 to A0 and B6 to B0 and latches the data whenever the clock $\phi$1 appears. The timing signal t0 is supplied to a reset terminal Res of the buffer 8.

The output (7 bits) of the buffer 8 are fed to the input terminals B6 to B0 of the adder 7 as mentioned before, and its upper four bits S6 to S3 are latched in a latch 9 at the input timing of a clock $\phi$8.

The 4-bit data latched in the latch 9 is coupled directly and also through inverters I3 to I0 to a decoder D1. In the decoder D1, shown by circles are AND gates. Shown by circles in a decoder D2 to be described later are OR gates, shown by circles in a decoder D3 are AND gates, shown by circles in a decoder D4 are OR gates, and shown by circles in a decoder D5 are OR gates.

As the output of the decoder D1, a "1" signal is provided on a line a when four-bit data of the latch 9, which are weighted by 8, 4, 2 and 1 from the uppermost rank bit, are all "0," on a line b if the aforementioned 4-bit data is "0001," on a line c if the 4-bit data is "001x" ("x" being either "0" or "1"), on a line d if the 4-bit data is "01xx," and on a line e if the 4-bit data is 1xxx."

The decoder 32 receives timing signals t3 to t7. With the timings t0 to t2, its lateral lines l to p are all "0." With the timing t3 ony the line l is "1," with the timing t4 only the lines l and m are "1," and so forth. With the timing t7 all the lines l to p are "1."

As the output of the decoder D3, to which the outputs on the lines a to e and the outputs on the lines l to p as mentioned above are supplied, the signals supplied to the decoder D4 with the timings t3 to t7 are all "1." Thus, with the timings t3 to t7 a signal of "1" is supplied to one input terminal of an AND gate 25. When the line a mentioned above is "1," 5 clock pulses $\phi$1 are provided as the clock $\phi$L for one period constituting the timings t0 to t7.

For instance, when the line e is at the "1" level, only the signal provided from the decoder D4 with the timing t7 is "1."

The clock $\phi$L provided through the AND gate 25 is as shown in Table 1 below.

TABLE 1

| Content of latch 9 | Output timing of clock $\phi$L |
|---|---|
| "0000" | t3, t4, t5, t6, t7 |
| "0001" | t4, t5, t6, t7 |
| "001x" | t5, t6, t7 |
| "01xx" | t6, t7 |
| "1xxx" | t7 |

In the decoder D5, 3-bit data supplied to the latch 26 is set according to the content of the latch 9. The 3-bit data coupled to the latch 26 are weighted as "1," "2" and "4" as shown in Table 2 below.

TABLE 2

| Content of latch 9 | Content transferred to latch 26 ("4", "2", "1") |
|---|---|
| "0000" | "100" |
| "0001" | "011" |
| "001x" | "010" |
| "01xx" | "001" |
| "1xxx" | "000" |

The latch 26 latches the aforementioned 3-bit data at the time of the appearance of the clock $\phi$8, and supplies the latched data to the amplifier 6 external to the LSI 1 for controlling the amplification level.

Figure 2:
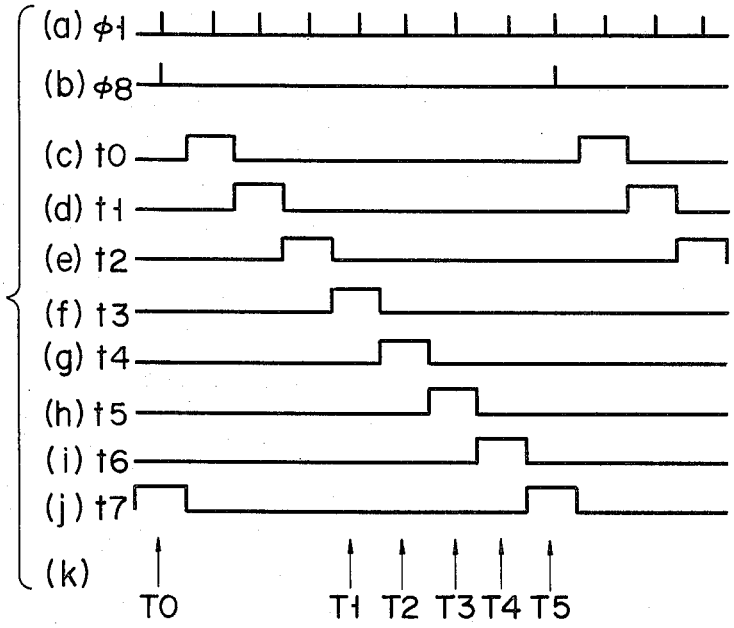
FIG. 2 is a time chart showing the operation of the circuit shown in FIG. 1.

Now, the operation of the embodiment will be described. FIG. 2 shows clock and timing signals supplied to the electronic musical instrument of this embodiment. Shown in (a) is the clock $\phi$1. Every time 8 clock pulses $\phi$1 are provided, a clock pulse $\phi$8 is provided as shown in (b).

Shown in (c) to (j) in FIG. 2 are timing signals t0 to t7 mentioned above. These timing signals t0 to t7 correspond to the timings of 8 musical sounds that are simultaneously produced. More particularly, the tone wave generating section 101 and envelope generating section 102 of this embodiment can produce up to 8 tones with a single circuit construction on a time division basis. The individual tone information (i.e., amplitude data) are repeatedly fed to the adder 2 with the relevant timings t0 to t7. The amplitude data supplied are of values obtained through envelope control.

To the adder 7 the upper 4-bit data of the envelope controlled data are supplied at the respective timings t0 to t7.

Thus, addition of the amplitude data for 8 tones is effected in the adder 2 and buffer 3, and addition of the envelope data of 8 tones is effected in the adder 7 and buffer 8 simultaneously.

The output of the buffer 3 is coupled through the gates G14 to G0, which are enabled with the timing t7, to the latches 24 to 10. The latches 24 to 10, to which the clock $\phi$1 is supplied as clock $\phi$L through the AND gate 25 at the timing t7, latches at this timing the data coupled to it through the gates G14 to G0.

At the same time, the envelope data corresponding to the amplitude data stored in the latches 24 to 10 is coupled to the latch 9 with the timing of the clock $\phi$8.

This timing is shown as timing T0 in (k) in FIG. 2.

With this timing T0, the decoders D1 to D5 operate according to the envelope data read into the latch 9. For example, when the data coupled to the latch 9 is "0000," five clock pulses $\phi$L are provided from the AND gate 25 with the timings t3 to t7 as shown in Table 1.

Thus, the contents of the latches 24 to 10 are upwardly shifted by 4 bits with the timings T1 to T4 as shown in (k) in FIG. 2, and the data shifted in this way are latched in the latches 41 to 30 with the timing T5 as shown in (k) in FIG. 2.

At the same time, with the timing T5 the data transmitted from the decoder D5, i.e., data "100" having the value "4" in the instant case, is latched in the latch 26. In the D/A converter 5, the data latched in the latches 41 to 30 is converted into an analog signal supplied to the amplifier 6 during the next cycle (t0 to t7). According to this analog signal, the amplifier 6 sets the amplification level on the basis of the data "4" latched in the latch 26 and provides a waveform signal through amplification.

The description so far has concerned with the case where the data stored in the latch 9 is "0000". Now, the case where the data is "1xxx" will be taken. When the data "1xxxx" is latched in the latch 9, a signal of "1" is supplied to the latches 24 to 10 as the clock $\phi$L only with the timing t7, i.e., only with the timing T0 shown in (k) in FIG. 2, and the clock $\phi$is not supplied for the other timings.

Thus, for the timing T5 the data provided from the buffer 3 with the timing t7 is supplied without any bit shift as the amplitude data latched in the latches 41 to 30. Also, in the timing T5 the data latched in the latch 26 is "000." Thus, the factor of amplification of the analog voltage provided through the D/A converter 5 by the amplifier 6 is 16 times that in case when data "100" is latched in the latch 26.

Figure 3A:
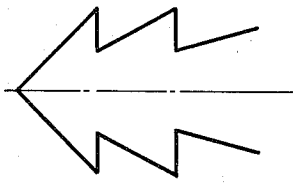
FIGS. 3A, 3B and 3C are views showing the resultant waveforms obtained through compression and expansion of output volume in the embodiment of FIG. 1.
Figure 3C:
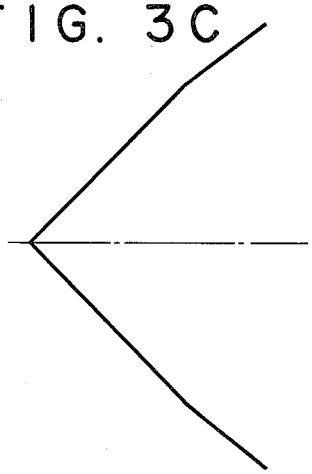
Figure 3B:
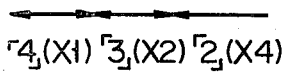

FIGS. 3A, 3B and 3C show this status. FIG. 3A shows the output level of the D/A converter 5. If the amplification factor of the amplifier 6 is "x1" in case when data coupled to the latch 26 is "4" as shown in FIG. 3B, i.e., when the actual amplitude data is latched after upward shift by 4 bits in the latches 41 to 30, it becomes "x2" when the data latched in the latch 26 is "3," i.e., the actual amplitude data is latched after upward shift by 3 bits to the latches 41 to 30.

Likewise, as the volume is gradually increased, the data stored in the latch 26, i.e., data shown in FIG. 3B, approaches "0," and the amplification factor is progressively changed at the timings of switching.

Thus, the range of the output of the D/A converter 5 is switched without overflow as shown in FIG. 3A, and the amplifier 6 effects correction of the range switching to provide amplification in the direction of gradually increasing the volume as shown in FIG. 3C.

Entirely the same control can also be obtained in case when the volume is gradually reduced.

It is to be understood that since with the above embodiment the sum of the amplitude data supplied to the D/A converter 5 is shifted by a predetermined number of bits according to the increase or reduction of the sum of the envelope data of all tones with increase or reduction of the number of output tones, whereby an effective range is set with respect to the D/A converter 5 to permit conversion of 12-bit data of a proper range into an analog signal through the D/A converter 5 and amplification of this analog signal through the amplifier 6 so as to obtain tone signal of proper output level, it is possible to prevent deterioration of the signal-to-noise ratio and deterioration of the tone quality (such as tone color) when the volume is low. Also, waveforms of substantially the same order of fineness (with respect to the amplitude) can be obtained irrespective of the volume level, so that it is possible to obtain a very natural musical sound or tone output covering a broad dynamic range.

While the above embodiment has concerned with an electronic musical instrument which can simultaneously produce up to 8 different tones, the invention is of course applicable to a single tone electronic musical instrument.

Further, while in the above embodiment 12-bit data has been coupled to the D/A converter 5, this number of the input data bits is by no means limitative, and it may be suitably changed. If the input data bit number is changed, the control circuit may also be appropriately changed.

Further, as the tone wave generating section and envelope control section of the electronic musical instrument according to the invention, any circuit system may be used so long as it is of the digitally controlled type.

Various further changes and modifications are also possible without departing from the scope and spirit of the invention.

As has been described in the foregoing, with the digital electronic musical instrument according to the invention, in which the shift level of the tone data supplied to the D/A converter is determined according to the envelope data, and the tone data is subjected to bit shift according to the shift level prior to supplying it to the D/A converter to obtain an analog signal, it is possible to always supply effective data to the D/A converter 5 and greatly improve the dynamic range of the electronic musical instrument. Further, since a musical sound of high quality can be obtained by providing a single D/A converter of a small bit number, a compact electronic musical instrument can be manufactured at a low cost.

What we claim is:

1. In a digital electronic musical instrument of the type including means for forming digital tone data, means for forming envelope data for controlling the envelope of said digital tone data, means for combining the digital tone data and envelope data to obtain envelope controlled digital composite tone data, and a digital-to-analog converter having a certain number of inputs for converting said ditigal composite tone data into an analog waveform signal, a tone data compressing and expanding system including:

means responsive to said envelope data forming means for setting a level of bit shift for the digital composite tone data before the digital composite tone data is supplied to the digital-to-analog converter according to the envelope data and for providing a corresponding output, and control means for supplying the digital composite tone data to the inputs of said digital-to-analog converter after the digital composite tone data is bit shifted by a number of bits corresponding to the output of said setting means, wherein compression and expansion of the tone data according to said envelope data are effected by the bit shift operation.

2. The tone data compressing and expanding system according to claim 1, wherein said setting means includes a latch for temporarily storing a predetermined number of upper bits of said envelope data, a decoder group for receiving the bit data stored in said latch and an AND gate having one input terminal for receiving the output of one decoder among said decoder group and another input terminal for receiving a clock signal.

3. The tone data compressing and expanding system according to claim 1, further comprising means for amplifying an output signal of said D/A converter, and means for controlling an amplification level of the amplifying means in response to another output of said setting means.

4. The tone data compressing and expanding system according to claim 2, which further comprises an amplifier for amplifying the output signal of said digital-to-analog converter, a second latch for latching the output of another decoder in said decoder group, and means for supplying the output of said second latch to said amplifier for controlling the amplification level of said amplifier.

5. The tone data compressing and expanding system according to claim 2, wherein said control means includes a plurality of first latches for latching the digital composite tone data for each bit, means for supplying the output of said AND gate as a latch timing signal to the first latches, a plurality of second latches for receiving from the first latches tone data which is bit shifted according to the output of the AND gate, and means for supplying the latched data from said second latches to the inputs of said digital-to-analog converter.

6. The tone data compressing and expanding system according to claim 1, wherein said digital electronic musical instrument produces a plurality of tone data on a time division basis, said setting means sets said level of bit shift according to sum data of a plurality of envelope data corresponding to said plurality of tone data, and said control means supplies sum data of said plurality of tone data to said digital-to-analog converter wherein said tone data is bit shifted according to said level of bit shift set by said setting means.

* * * * *